United States Patent [19]

Okada et al.

[11] Patent Number: 4,882,126

[45] Date of Patent: Nov. 21, 1989

[54] HIGH-STRENGTH ZINC BASE ALLOY

[75] Inventors: Atsuyuki Okada, Tokyo; Kouhei Kubota; Tsutomu Satoh, both of Ageo; Hiroshi Gotoh, Ageo; Takeshi Oziro, Ageo, all of Japan

[73] Assignee: Mitsui Mining & Smelting Co., Ltd., Tokyo, Japan

[21] Appl. No.: 209,977

[22] Filed: Jun. 22, 1988

[30] Foreign Application Priority Data

| | | | |
|---|---|---|---|
| Jul. 1, 1987 | [JP] | Japan | 62-162220 |
| Dec. 24, 1987 | [JP] | Japan | 62-329387 |
| Apr. 20, 1988 | [JP] | Japan | 63-97934 |

[51] Int. Cl.[4] ..... C22C 18/04

[52] U.S. Cl. ..... 420/516; 420/518

[58] Field of Search ..... 420/516, 518; 148/441

[56] References Cited

U.S. PATENT DOCUMENTS

| | | | |
|---|---|---|---|
| 1,663,215 | 3/1928 | Peirce et al. | 420/516 |
| 2,013,870 | 9/1935 | Starmann | 420/516 |
| 2,467,956 | 4/1949 | Bierman | 420/516 |
| 2,720,459 | 10/1955 | Holzwarth | 420/516 |
| 3,567,436 | 3/1971 | Isobe et al. | 420/516 |
| 3,720,510 | 3/1973 | Isobe et al. | 420/516 |
| 4,126,450 | 11/1978 | Lathrop et al. | 420/516 |

FOREIGN PATENT DOCUMENTS

| | | | |
|---|---|---|---|
| 891750 | 10/1953 | Fed. Rep. of Germany . | |
| 32053 | 3/1973 | Japan | 420/516 |
| 233905 | 8/1944 | Switzerland . | |
| 176685 | 12/1965 | U.S.S.R. . | |
| 462052 | 2/1937 | United Kingdom | 420/516 |
| 512758 | 11/1937 | United Kingdom | 420/516 |
| 571986 | 10/1945 | United Kingdom . | |
| 935276 | 8/1963 | United Kingdom | 420/516 |

*Primary Examiner*—Robert McDowell

*Attorney, Agent, or Firm*—Flynn, Thiel, Boutell & Tanis

[57] ABSTRACT

A high-strength zinc base alloy which contains 5.2 to 8.6 wt % of Al, 3.0 to 6.5 wt % of Cu, 0.01 to 0.20 wt % of Mg, and if necessary, 0.30 wt % or less of one or two of Co and Ni, and/or 0.04 wt % or less of Ti, the balance being substantially composed of Zn, and which is suitable for a metal mold and die casting.

9 Claims, No Drawings

HIGH-STRENGTH ZINC BASE ALLOY

BACKGROUND OF THE INVENTION

1. Field of the Invention

The present invention relates to a high-strength zinc base alloy, and particularly to a zinc base alloy which has high mechanical strength, a low casting temperature and a good fluidity, and which is suitable for use in molds and die casting.

2. Description of the Prior Art

It is thought that zinc base alloys may generally be used in molds and die casting.

Zinc base alloys for molds are first described below. It is known that the zinc base alloys may be employed in experimental molds utilizing the good casting properties thereof. Such experimental molds are generally used for experimentally manufacturing, for example, injection-molded products or sheet metal workpieces of automobile parts, and are thus distinguished from general-type molds used for mass-producing articles. In view of the need to ensure that each of the experimental molds used has a proper degree of strength, can be formed in a short time and is low-priced, experimental molds are manufactured by sand mold casting into shapes which substantially need not be subjected to cutting and are similar to the final shape required in each case and are then subjected to finishing polishing. Most of such zinc base molds are presently made of ZAS alloy (trade name; Al, 3.9 to 4.3%; Cu, 2.5 to 3.5%; Mg, 0.03 to 0.06%; balance; Zn). This ZAS alloy is suprior to other alloys with respect to its good pattern reproducibility, mechanical strength and the ease with which it is subjected to melt casting.

Iron base molds which are obtained by cutting and grinding a large steel forged block are used as general-type molds. Such iron base molds have such high strength that the can withstand several hundreds of thousands of shot operations, but they involve a long delivery time and are high-priced.

However, since there has been a recent tendency to produce many kinds of articles in small amounts, the use of a conventional steel mold which involves a long delivery time and has a high cost raises the effective cost of each mold that has to be borne by each product. There has therefore been a demand for the appearance of a mold which can be produced easily and is low-priced. There is a strong demand for a zinc base alloy that can be applied to a mold for mass-producing which can withstand five hundred thousand shot operations. Thus, various proposals with respect to zinc base alloys that can be used for molds have been made. If a ZAS alloy of the type known to be generally used for experimental molds is used for the above-described purpose without modification, the ZAS alloy mold obtained is slightly short of strength and fails to display the strength needed to withstand several hundred thousand shot operations. Although various types of improved zinc base alloys have therefore been produced by way of experiment with a view to increasing the strength of ZAS alloy, none of these alloys has been able to solve the problem that the low casting temperature and excellent flow properties which are the merits of a ZAS alloy have to be sacrificed to some extent.

At present, two types of zinc base alloys for die casting are specified by JIS. It is thought that, of these two alloys, an overwhelmingly large amount of the zinc base casting alloy class 2 (ZDC2) is used and accounts for 95% of the total amount of zinc base alloy used. This ZDC2 is an alloy composed of 3.9 to 4.3 wt% of Al, 0.03 to 0.06 wt% by of Mg, substantially all the balance being Zn. It has been used for about 35 years, and is widely utilized in mechine parts, decorative parts and articles for daily needs. This ZDC2 is characterized by the advantages that hot chamber die casting is possible because it has a long mold life, an appropriate mechanical strength, is readily machined and easily plated.

However, in recent times, the fields in which Zn die castings are employed have has been increasingly narrowed with the advent of plastic materials and Al die castings the qualities of which have been improved to a remarkable extent. There has therefore been a demand for the appearance of a new Zn base alloy for die casting which can expand the market for Zn die castings and which not only has high strength but may also be made thin. To this end, several improved Zn base alloys have been developed. However, none of these improved Zn base alloys has solved the problem that the low casting temperature and good fluidity which are the merits of Zn base alloys are sacrificed to some extent because the strengths thereof are given priority over other their properties.

SUMMARY OF THE INVENTION

It is an object of the present invention to provide a zinc base alloy having high mechanical strength.

It is another object of the present invention to provide a zinc base alloy for metal molds which exhibits a lower casting temperature than that of ZAS alloy and excellent fluidity, and which is extremely suited to use in attempts to significantly increase the strength of mold while facilitating the production of many kinds of articles in small amounts to the extent of several hundred thousand shot operations.

It is a further object of the present invention to provide a zinc base alloy for die casting which has a lower casting temperature than that of ZDC2 and excellent fluidity, and which enables a significant increase in strength to be attained.

In accordance with the present invention, a high-strength zinc base alloy contains 5.2 to 8.6 wt% of Al, 3.0 to 6.5 wt% of Cu, 0.01 to 0.20 wt% of Mg, and if required, 0.30 or less of one or two of Co and Ni, and/or 0.40 wt% or less of Ti, the balance being composed of Zn except for inevitable impurities.

The percentages described below are expressed in terms of weight.

DETAILED DESCRIPTION OF THE INVENTION

As a result of investigations performed by the inventors, it was found that an alloy close to Zn—6.8% Al—4.0% Cu has a solidification start temperature of about 390° C. which is about 30° C. lower than that of ZAS alloy nd substantially the same as that of ZDC2, as well as having a lower casting temperature than that of ZAS alloy and good fluidity which is significantly superior to that of ZDC2. Such good fluidity enables the melt temperature during die casting to be lowered and the life of a mold to be increased, as well as enabling the manufacture of a thin die casting layer. In addition, the same alloy system has a greatly hightened mechanical strength as compared with ZAS alloy and ZDC2 alloy and a tensile strength at room temperature of 40 $Kgf/mm^2$ or more which represents the maximum level obtainable for a Zn base alloy. This means that employing such an alloy enables the production of a metal mold which can withstand injection molding for about 5 hundred thousand shot operations. It was also found that both the occurrence of casting defects caused by gravity segregation which is apprehended by increasing the amount of Al and Cu as compared with ZAS alloy and ZDC2 alloy and the reduction in the impact value can be kept to a level which does not involve any practical problems, and that the addition of one or two of Co, Ni and Ti to the same alloy system increases the strength (impact value) and improves the fluidity of a melt. The present invention has been achieved on the basis of these findings.

A description will now be made of the reasons for the limits set for the constituent components in the present invention.

An Al component is effective for increasing the strength of an alloy. The Al component is also a factor determining the fluidity of a melt. Although Al improves the fluidity in the region of a Zn-Al-Cu ternary system where the primary crystal is in an $\epsilon$ phase (Cu solid solution) or $\epsilon$ phase (Zn-Cu solid solution), it inhibits the fluidity of a melt in the region where the primary crystal is in a $\beta$ phase (Al solid solution). In addition, the amount of bubbles remaining in a casting increases with any increase in the amount of Al. The content of Al is determined by considering these various conditions. In other words, if the content of Al is less than 5.2%, the characteristic of the alloy of the present invention whereby the high strength and the high degree of fluidity of a melt are compatible with each other is not exhibited, while if the content of Al is over 8.6%, the fluidity of a melt deteriorates and the amount of bubbles remaining in a casting will increases. Therefore, both cases are undesirable.

The Cu component is uniformly distributed in an alloy and forms an $\epsilon$ phase (Zn-Cu solid solution) and ternary peritectic eutectic phase (Zn-Al-Cu solid solution) and has the function of remarkably increasing the strength of an alloy, as well as having a large effect on the fluidity of a melt. However, if the Cu content is increased, the solidification start temperature of the alloy is also raised so that the difference in this temperature from 380° C. which is the solidification end temperature of the alloy is increased. In other words, if the Cu content is raised, the range of the solidification temperatures is widened and the fluidity of a melt thus deteriorates, resulting in the need to raise the melt temperature for the purpose of keeping a constant level of fluidity. In this way, the Cu content influences the easiness of casting and the strength of the alloy. Namely, if the Cu content is less than 3%, the strength is insufficient, while if the Cu content is over 6.5%, the fluidity of a melt deteriorates. Therefore, both cases are undesirable.

The Mg component has the function of preventing the intercrystalline corrosion that readily takes place in a Zn alloy containing Al as well as the effect of slowing down the rate of the aging reaction that takes place in such an alloy system. The lower limit of Mg content that is capable of fulfilling this function of preventing intercrystalline corrosion is 0.01%. On the other hand, as shown in the test examples described below, although the tensile strength of the alloy is slightly increased as the amount of Mg added is increased, if the Mg content goes over 0.2%, cleavage easily occurs and the impact value is reduced. Therefore, the practical range of Mg content is 0.01 to 0.2%.

The Co and Ni components both coexist with Al in a melt to form compounds. The Co forms $Al_9Co_2$ and the Ni forms $Al_3Ni$. The behaviors of Co and Ni in an alloy are similar to each other, and the functions thereof in the alloy are also similar. The Co and Ni have equivalent functions and have the effects of increasing the tensile strength and elongation properties, as well as improving the fluidity of a melt if added in an amount of 0.1% or less. However, as shown in the test examples, the addition of excessive amounts of Co and Ni causes a reduction in the impact value. In consideration of the above-described several conditions, as well as the high price of Co, the amount of one or two of Co and Ni added is in practice 0.3% or less, preferably 0.03 to 0.20%.

The Ti component forms a compound of $Al_3Ti$ in a melt, and the $Al_3Ti$ has an effective function in terms of grain refinement. The alloy system of the present invention includes three cases which respectively involve the primary crystals being in $\alpha$ phase (Zn solid solution), $\beta$ phase (Al solid solution) and $\epsilon$ phase (Zn-Cu solid solution), corresponding to the combinations of Al and Cu, and the $Al_3Ti$ exhibits its function in terms of grain refinement in all of these three cases. The $Al_3Ti$ increases the tensile strength and the impact value of the alloy, but if a large amount of Ti is added, the impact value of the level of fluidity are decreased. Since the function of Ti is fundamentally different from the functions of the Co and Ni, any reduction in the level of fluidity which is a fault of the addition of Ti can be compensated for by adding both Co and Ni, without any adverse effect being produced on each other. The practical amount of Ti added is 0.40% or less, preferably 0.03 to 0.10%.

The above-described alloy to which the present invention relates displays the improved characteristics that the alloy can be easily subjected to melt casting as compared with the ZAS alloy that is generally used for experimental metal molds, as well as ZDC2 alloy, and also that the mechanical properties are significantly improved, these characteristics having been essentially incompatible with each other. Therefore, if a casting metal mold is manufactured by the alloy of the present invention, the mold can be applied in the field of steel molds used as metal molds for mass production to the extent of 5 hundred thousand shot operations, and a general mold can be manufactured with a delivery time and at a cost which are substantially the same as those of experimental molds because the alloy of the present invention is more easily melt-casted than the conventional ZAS alloy.

At the same time, the alloy of the present invention enables the weight of a die casting to be reduced by forming a thin layer and is thus useful alloy which enables the development of new applications for zinc die casting and expansion of the applications thereof.

Examples of the present invention are described below.

EXAMPLE 1

This example is performed for the purpose of showing the usefulness of the alloy of the present invention as a zinc base alloy for a metal mold.

The required amount of each of Al, Cu, Mg, together with Co and Ni and Ti as required, in the form of a master alloy were added to electrolytic zinc (Zn) as a base in a graphite crucible, and each of the resulting alloys with the compositions shown in Table 1 was melted. Each of the obtained melts was casted into a mold heated at 350° C. to form test piece castings respectively having a diamter of 16 mm and a length of 200 mm and 10 mm squares and a length of 200 mm. The reason for heatng the mold at 350° C. is that the cooling rate of the alloy is approximated to the cooling rate of a large ingot in an actual sand mold.

Test pieces such as tensile test pieces and impact test pieces were formed from the thus-obtained test piece castings, and then used in the tests described below.

The characteristic value obtained in each of these tests was the value obtained at 100° C., which is close to the mold temperature during plastic injection molding.

* Tensile test:

By means of an Instron tensile machine

| | | |
|---|---|---|
| Conditions: | gauge length | 50 mm |
| | tensile speed | 10 cm/min at 100° C. |

* Impact value:

By means of a Charpy impact tester

Conditions: the section of a test piece had 10 mm squares and no notch, 100° C.

* Fluidity test (determination of an optimum casting temperature)

A melt containing required constituents was well agitated and kept at a given temperature. One end of a glass tube with an external diameter of 6 mmϕ and an internal diameter of 4 mmϕ was inserted into the melt, and a negative pressure of 240 mmHg was applied to the other end thereof. At this time, the weight of the metal which flowed into the glass tube and solidified was measured to obtain an inflow. It is judged that an alloy showing a larger inflow and a larger weight of solidified metal has better fluidity. According to our experience, the temperature at which 20 g of the metal flows into the glass tube in this test represents the optimum casting temperature.

The obtained results are shown in Table 1.

TABLE 1

| No. | Component (%) Al | Cu | Mg | Co | Ni | Ti | Zn | 100° C. tensile test, tensile strength (Kgf/mm²) | Elongation (%) | 100° C. impact value (Kg-m/cm²) | Optimum casting temperature (°C.) |
|---|---|---|---|---|---|---|---|---|---|---|---|
| 1 | 4.32 | 5.28 | 0.046 | — | — | — | balance | 28.5 | 5.2 | 4.57 | 480 |
| 2 | 5.21 | 5.39 | 0.054 | — | — | — | balance | 28.9 | 5.9 | 4.34 | 445 |
| 3 | 6.85 | 5.46 | 0.045 | — | — | — | balance | 29.3 | 6.7 | 4.81 | 425 |
| 4 | 8.53 | 5.53 | 0.048 | — | — | — | balance | 30.8 | 18.2 | 6.23 | 450 |
| 5 | 9.97 | 5.41 | 0.052 | — | — | — | balance | 32.6 | 2.1 | 0.95 | 520 |
| 6 | 6.63 | 2.32 | 0.052 | — | — | — | balance | 27.1 | 8.5 | 4.10 | 470 |
| 7 | 6.76 | 3.04 | 0.051 | — | — | — | balance | 28.5 | 9.7 | 4.90 | 425 |
| 8 | 6.95 | 4.12 | 0.047 | — | — | — | balance | 28.8 | 3.6 | 6.09 | 410 |
| 9 | 6.81 | 6.38 | 0.054 | — | — | — | balance | 29.1 | 3.7 | 5.12 | 430 |
| 10 | 6.74 | 10.73 | 0.060 | — | — | — | balance | 31.5 | 4.1 | 1.75 | 473 |
| 11 | 6.90 | 4.02 | 0 | — | — | — | balance | 28.5 | 20.3 | 6.50 | 410 |
| 12 | 6.87 | 4.16 | 0.010 | — | — | — | balance | 28.9 | 26.2 | 6.82 | 410 |
| 13 | 7.02 | 3.92 | 0.020 | — | — | — | balance | 29.3 | 23.8 | 8.23 | 410 |
| 14 | 6.92 | 3.97 | 0.193 | — | — | — | balance | 29.2 | 3.5 | 4.52 | 415 |
| 15 | 6.81 | 4.17 | 0.319 | — | — | — | balance | 29.4 | 2.3 | 1.53 | 420 |
| 16 | 6.91 | 5.28 | 0.023 | 0.011 | — | — | balance | 29.6 | 22.5 | 5.93 | 425 |
| 17 | 6.69 | 5.33 | 0.022 | 0.019 | — | — | balance | 30.1 | 21.3 | 6.40 | 420 |
| 18 | 6.68 | 5.46 | 0.023 | 0.08 | — | — | balance | 30.9 | 15.2 | 7.01 | 415 |
| 19 | 6.63 | 5.44 | 0.019 | 0.29 | — | — | balance | 29.5 | 5.0 | 4.90 | 430 |
| 20 | 6.83 | 5.83 | 0.021 | 0.62 | | — | balance | 28.9 | 3.8 | 3.38 | 455 |
| 21 | 6.75 | 5.43 | 0.022 | — | 0.010 | — | balance | 29.1 | 14.5 | 5.53 | 420 |
| 22 | 6.81 | 5.30 | 0.021 | — | 0.021 | — | balance | 29.5 | 14.0 | 6.10 | 420 |
| 23 | 6.77 | 5.38 | 0.021 | — | 0.095 | — | balance | 30.2 | 13.0 | 6.30 | 420 |
| 24 | 6.90 | 5.50 | 0.021 | — | 0.28 | — | balance | 29.8 | 5.8 | 4.12 | 430 |
| 25 | 6.70 | 5.51 | 0.023 | — | 0.45 | — | balance | 28.3 | 3.2 | 3.15 | 455 |
| 26 | 7.00 | 5.15 | 0.025 | 0.15 | 0.11 | — | balance | 30.9 | 10.0 | 7.95 | 430 |
| 27 | 6.95 | 5.10 | 0.021 | 0.12 | 0.23 | — | balance | 29.9 | 3.1 | 3.21 | 450 |
| 28 | 6.98 | 5.05 | 0.022 | 0.23 | 0.15 | — | balance | 29.7 | 3.0 | 3.22 | 450 |
| 29 | 6.96 | 5.12 | 0.021 | 0.25 | 0.31 | — | balance | 29.1 | 2.0 | 2.05 | 455 |
| 30 | 6.99 | 5.08 | 0.023 | 0.32 | 0.20 | — | balance | 29.0 | 2.5 | 2.58 | 455 |
| 31 | 6.61 | 5.49 | 0.051 | — | — | 0.02 | balance | 29.2 | 6.8 | 4.75 | 425 |
| 32 | 6.83 | 5.52 | 0.047 | — | — | 0.03 | balance | 29.7 | 6.5 | 4.42 | 425 |
| 33 | 6.84 | 5.64 | 0.051 | — | — | 0.12 | balance | 30.7 | 4.8 | 4.45 | 430 |
| 34 | 6.95 | 5.39 | 0.049 | — | — | 0.40 | balance | 31.1 | 3.2 | 4.23 | 445 |
| 35 | 6.91 | 5.47 | 0.053 | — | — | 0.51 | balance | 31.0 | 2.6 | 3.32 | 455 |
| 36 | 6.67 | 5.53 | 0.055 | 0.112 | — | 0.025 | balance | 29.7 | 6.7 | 5.35 | 415 |
| 37 | 6.73 | 5.47 | 0.053 | 0.098 | — | 0.106 | balance | 31.8 | 7.4 | 6.52 | 420 |
| 38 | 6.85 | 5.42 | 0.049 | 0.095 | — | 0.36 | balance | 31.7 | 4.3 | 7.11 | 440 |
| 39 | 6.84 | 5.49 | 0.050 | 0.107 | — | 0.55 | balance | 30.0 | 1.5 | 3.10 | 445 |
| 40 | 6.93 | 5.25 | 0.031 | — | 0.095 | 0.11 | balance | 30.1 | 13.2 | 7.25 | 425 |
| 41 | 6.90 | 5.30 | 0.030 | — | 0.20 | 0.19 | balance | 32.3 | 12.0 | 8.0 | 425 |
| 42 | 6.78 | 5.28 | 0.029 | — | 0.44 | 0.11 | balance | 29.7 | 8.5 | 6.50 | 455 |
| 43 | 6.91 | 5.23 | 0.027 | — | 0.18 | 0.49 | balance | 28.7 | 7.6 | 5.32 | 455 |
| 44 | 6.90 | 5.21 | 0.025 | — | 0.47 | 0.45 | balance | 26.5 | 1.9 | 2.13 | 460 |
| 45 | 7.11 | 5.30 | 0.018 | 0.15 | 0.058 | 0.11 | balance | 31.5 | 9.5 | 7.55 | 425 |
| 46 | 7.05 | 5.33 | 0.020 | 0.10 | 0.13 | o.098 | balance | 32.3 | 11.0 | 6.82 | 430 |
| 47 | 7.13 | 5.35 | 0.019 | 0.47 | 0.11 | 0.11 | balance | 29.5 | 3.1 | 2.83 | 455 |
| 48 | 7.12 | 5.28 | 0.022 | 0.15 | 0.49 | 0.099 | balance | 28.8 | 2.0 | 2.05 | 460 |
| 49 | 7.08 | 5.31 | 0.021 | 0.43 | 0.45 | 0.10 | balance | 25.3 | 0.9 | 1.53 | 460 |

TABLE 1-continued

| No. | Component (%) Al | Cu | Mg | Co | Ni | Ti | Zn | 100° C. tensile test, tensile strength (Kgf/mm²) | Elongation (%) | 100° C. impact value (Kg-m/cm²) | Optimum casting temperature (°C.) |
|---|---|---|---|---|---|---|---|---|---|---|---|
| 50 | 4.04 | 3.06 | 0.044 | — | — | — | balance | 24.0 | 6.2 | 6.85 | 450 |

The findings described below are obtained from the results of tests shown in Table 1.

As it is clear from Sample Nos. 1 to 5, the strength (tensile strength) increases as the amount of Al added increases. However, the optimum casting temperature rises from the lowest value at which the Al content is 6.8% either if the amount of Al added is decreased or increased.

As it is clear from Sample Nos. 6 to 10, the strength (tensile strength) increases as the amount of Cu added increases. However, the optimum casting temperature rises from the lowest value at which the Cu content is 4.0% either if the Cu content is decreased or increased.

It is also found that any one of the alloys of this example of the present invention shows an optimum casting temperature lower than 450° C. of ZAS alloy of Sample No. 50. By the way, if a casting temperature becomes over 450° C., there is the tendency that, since the time required until solidification takes place is long, a degree of thermal strain is increased and pinholes are easily produced. Since each of the alloys of this example of the present invention has a strength (tensile strength) within the range of 28.5 to 30.8 Kgf/mm², increases in the strengths by 4.5 to 6.8 Kgf/mm² are obtained as compared with the strength of 24.4 kgf/mm² of ZAS alloy (Sample No. 50).

As it is clear from Sample Nos. 11 to 15, although the strength (tensile strength) and the optimum casting temperature are not significantly effected by any increases in the amount of Mg added, if the Mg content is 0.2% or more, the strength is slightly decreased, while the impact value is extremely decreased.

As it is clear from Samples 16 to 20, if the Co content is over 0.3%, the strength (tensile strength) and the impact value are reduced, and the optimum casting temperature is raised. On the other hand, if the Co content is within the range of 0.02 to 0.3%, the strength (tensile strength) is increased while the characteristics of elongation and impact values being maintained.

As it is clear from Sample Nos. 21 to 25, if the Ni content is over 0.3%, the strength (tensile strength) and the impact value are both decreased, and the optimum casting temperature is raised. However, when the Ni content is within the range of 0.01 to 0.3%, the strength (tensile strength) and elongation are slightly increased, while the characteristics of the optimum casting temperature and the impact value are maintained.

As it is clear from Sample Nos. 26 to 30, in each of the samples to which Co and Ni were both added, if the total amount of these metals added is over 0.3%, the strength (tensile strength) and the impact value are decreased, and the optimum casting temperature is raised. While, if the total amount of Co and Ni is 0.3% or less, the strength (tensile strength) and the impact value are increased while the characteristic of the optimum casting temperature being maintained.

As it is clear from Sample Nos. 31 to 35, if the Ti content is over 0.4%, the impact value is decreased, and the optimum casting temperature is raised. However, if the Ti content is within the range of 0.03 to 0.4%, the strength (tensile strength) is increased while the characteristics of the optimum casting temperature and the impact value being maintained.

In addition, in each of Sample Nos. 36 to 39 to which Co and Ni were both added, the optimum casting temperature is lower than 450° C. of ZAS alloy and the elongtion and the impact value are equivalent to or more those of the ZAS alloy, but the strength is 29.7 to 31.7 Kgf/mm², resulting in an increase by 5.7 to 7.7 Kgf/mm² as compared with the ZAS alloy.

In each of Sample Nos. 40 to 44 to which Ni and Ti were both added, the optimum casting temperature is lower than 450° C. of the ZAS alloy and the elongation and the impact value are equivalent to or more those of the ZAS alloy, but the strength is 30.1 to 32.3 Kgf/mm², resulting in an increase in the strength by 6.1 to 8.3 Kgf/mm² as compared with the ZAS alloy.

As it is clear from Sample Nos. 45 to 49, when Ni, Co and Ti are added, if the total amount of Ni and Co is 0.30% or less, the optimum temperature is lower than 450° C. of the ZAS alloy and the degree of elongation and the impact value are larger than those of the ZAS alloy, but the strength is 31.5 to 32.3 Kgf/mm², resulting in increases in the strength by 7.5 to 8.3 Kgf/mm² as compared with ZAS alloy.

Typical examples are described above as test examples, but when the compounding ratio of each of the constituents was changed within the scope of the present invention, the same effects were obtained.

EXAMPLE 2

This example was performed for the purpose of showing the usefulness of the alloy of the present invention as a zinc base alloy for die casting.

Required amounts of Al, Cu and Mg, and if necessary, Co, Ni and Ti in the form of a master alloy were added to electrolytic zinc (Zn) as a base in a graphite crucible to form alloys having the compositions shown in Table 2 on an experimental basis. The fluidity of each of the formed alloys was measured in a molten state. Test pieces used for examining mechanical properties were formed by direct hot chamber die casting. The formed test pieces included test pieces for tensile tests which each had a length of 230 mm with a parallel portion having a diameter of 6 mm and test pieces for impact tests which each had 6.35 mm squares. The condition of die casting were such tht the melt temperature was 420° C., the mold temperature was 150° C., the mold locking force was 250 ton, and accumulator pressure of a die casting machine ws 85 Kgf/cm².

These test pieces were used in the following tests:

* Tensile test

By means of an Instron tensile machine

| | | |
|---|---|---|
| Conditions: | Gauge length | 50 mm |
| | Cross section | 6 mm |

-continued

| | |
|---|---|
| Rate of pulling at room temperature | 10 cm/min |

* Impact test

By means of a Charpy impact tester

Conditions: Cross section of a test piece; a 6.35 mm square without any notches at room temperature

* Fluidity test

A melt containing given components was well agitated and kept at 420° C. One end of a glass tube having an external diameter of 6 mm and an internal diameter of 4 m was inserted into the melt, and negative pressure of 240 mmHg was applied to the other end thereof. At this time, the weight of the solidified metals which flowed into the glass tube was measured to obtain an inflow. It was decided that an alloy showing a greater inflow and a greater weight of the solidified metals has better fluidity.

The obtained results are shown in Table 2.

TABLE 2

| No. | Component (%) Al | Cu | Mg | Co, Ni | Ti | Zn | Tensile strength (Kgf/mm$^2$) | Impact value (Kgf-m/mm$^2$ | Fluidity, inflow at 420° C. (g) |
|---|---|---|---|---|---|---|---|---|---|
| 1 | 4.02 | — | 0.041 | — | — | balance | 29.7 | 11.7 | 14.2 |
| 2 | 4.62 | 4.05 | 0.022 | — | — | balance | 33.4 | 5.9 | 9.6 |
| 3 | 5.28 | 4.02 | 0.021 | — | — | balance | 38.6 | 4.6 | 16.8 |
| 4 | 7.02 | 3.98 | 0.022 | — | — | balance | 43.3 | 4.6 | 32.7 |
| 5 | 8.48 | 4.11 | 0.020 | — | — | balance | 43.8 | 3.7 | 16.2 |
| 6 | 9.06 | 4.02 | 0.021 | — | — | balance | 45.5 | 1.7 | 9.3 |
| 7 | 6.98 | 1.85 | 0.019 | — | — | balance | 36.4 | 4.4 | 13.4 |
| 8 | 7.05 | 3.11 | 0.021 | — | — | balance | 38.8 | 4.2 | 17.0 |
| 9 | 7.06 | 6.31 | 0.022 | — | — | balance | 46.9 | 2.2 | 15.1 |
| 10 | 7.14 | 6.63 | 0.020 | — | — | balance | 47.8 | 1.4 | 11.6 |
| 11 | 7.03 | 4.11 | 0.18 | — | — | balance | 33.2 | 2.1 | 25.2 |
| 12 | 7.02 | 4.12 | 0.22 | — | — | balance | 30.5 | 0.9 | 23.6 |
| 13 | 7.10 | 3.99 | 0.021 | CO, 0.07 Ni, 0.04 | — | balance | 45.1 | 4.5 | 33.6 |
| 14 | 7.00 | 4.07 | 0.019 | Co, 0.17 Ni, 0.12 | — | balance | 46.3 | 2.3 | 30.2 |
| 15 | 6.93 | 4.03 | 0.020 | Co, 0.17 Ni, 0.18 | — | balance | 46.2 | 1.2 | 27.5 |
| 16 | 6.95 | 4.03 | 0.020 | — | 0.09 | balance | 46.1 | 5.8 | 32.0 |
| 17 | 7.07 | 3.97 | 0.023 | — | 0.38 | balance | 45.9 | 3.7 | 15.6 |
| 18 | 7.08 | 3.98 | 0.022 | — | 0.44 | balance | 44.3 | 3.1 | 8.2 |
| 19 | 6.83 | 4.02 | 0.019 | Co, 0.10 | 0.12 | balance | 46.5 | 5.6 | 31.8 |
| 20 | 6.96 | 4.09 | 0.023 | Co, 0.17 Ni, 0.11 | 0.36 | balance | 43.1 | 3.0 | 14.8 |
| 21 | 7.05 | 4.10 | 0.022 | Co, 0.21 Ni, 0.12 | 0.13 | balance | 44.3 | 0.9 | 24.9 |
| 22 | 7.12 | 4.09 | 0.021 | Co, 0.05 Ni, 0.06 | 0.45 | balance | 44.6 | 1.8 | 9.4 |
| 23 | 7.03 | 3.99 | 0.019 | Co, 0.12 | — | balance | 45.5 | 4.6 | 34.0 |
| 24 | 7.08 | 4.10 | 0.020 | Ni, 0.11 | — | balance | 45.3 | 4.7 | 32.9 |

The findings described below are obtained from the results of tests shown in Table 2.

As it is clear from Sample Nos. 2 to 6, the strength (tensile strength) is increased as the amount of Al added increases. However, the degree of fluidity of a melt is decreased from the maximum value at which the Al content was 7.2% either if the Al content was decreased or it was increased.

In addition, as it is clear from Sample Nos. 7 to 10, the strength (tensile strength) increases as the amount of Cu added increases. However, the degree of fluidity of a melt is decreased from the maximum value at which the Cu content was 4.0% either if the Cu content was decreased or it was increased.

It is also found that each of the alloys of this example of the present invention has better fluidity of a melt than that of ZDC2 of Sample No. 1 which shows an inflow of 14.2 g. In other words, the better fluidity of a melt than that of ZDC2 means that a die casting can be made in a thin layer and light.

In addition, each of the alloys of this example of the present invention has strength (tensile strength) within the range of 33.2 to 47.8 kgf/mm$^2$, resulting in a significant increase from 29.8 Kgf/mm$^2$ of the ZDC2 (Sample No. 1).

As it is clear from Sample Nos. 4, 11 and 12, the reduction in the impact value increases as the amount of Mg added increases, and if the Mg content is over 0.20%, the alloy becomes unsuitable for practical use. It is thought that this phenomenon is caused by a close relationship between the Mg content and the easy occurrence of cleavage of a Zn alloy quenched. This is the reason for an decrease in the tensile strength if the Mg content is over 0.2%.

As it is clear from Sample Nos. 13 to 15 and 23 and 24, in the alloy system of the present invention, the functions of Co and Ni are very similar to each other. If the total amount of Co and Ni is less than about 0.1%, the degree of fluidity and the strength (tensile strength) are increased, while if the total amount of Co and Ni added is 0.1%, the impact value is remarkably decreased, and if the amount is 0.3% or more, the alloy does not stand practical use.

As it is clear from Sample Nos. 16 to 18, if the Ti content is over 0.40%, the degree of fluidity of a melt is decreased to a value lower than that of ZDC2. However, in the case such as die casting in which a Zn alloy is quenched, Ti has the effect of increasing the impact value so far as the Ti content is about 0.1% or less. If the Ti content is over 0.1%, the decreases in the impact value and the degree if fluidity start, and if the Ti content is over 0.4%, the alloy does not stand practical use.

As it is clear from Sample Nos. 19 to 22, of the samples to which 0.1% of each of Co +Ni and Ti was added, the sample containing about 6.8% of Al and about 4.0% of Cu shows the maximum strength (tensile strength) and an impact value of as high as 6.6 Kgf/cm$^2$. Therefore, since each of Ti and Co and Ni in the ally system of the present invention respectively exhibits the advantage thereof, it is possible to make up for defects of each other.

Although typical alloys are described above as test examples, when the compounding ratio of each of the constituents was changed within the scope of the present invention, the same effects were obtained.

What is claimed is:

1. A high-strength zinc base alloy consisting of 5.2 to 8.6 wt.% of Al, 3.0 to 6.5 wt.% of Cu, 0.01 to 0.20 wt.% of Mg, 0.03 to 0.3 wt.% of a member selected from the group consisting of Co and a mixture of Co and Ni, and the balance being Zn.

2. A metal mold or die casting comprising a high-strength zinc base alloy consisting of 5.2 to 8.6 wt.% of Al, 3.0 to 6.5 wt.% of Cu, 0.01 to 0.20 wt.% of Mg, 0.03 to 0.3 wt.% of a member selected from the group consisting of Co and a mixture of Co and Ni, and the balance being Zn.

3. A high-strength zinc base alloy consisting of 6.68 wt.% of Al, 5.46 wt.% of Cu, 0.023 wt.% of Mg, 0.08 wt.% of Co, and the balance being Zn.

4. A high-strength zinc base alloy consisting of 6.77 wt.% of Al, 5.38 wt.% of Cu, 0.021 wt.% of Mg, 0.095 wt.% of Ni, and the balance being Zn.

5. A high-strength zinc base alloy consisting of 7.00 wt.% of Al, 5.15 wt.% of Cu, 0.025 wt.% of Mg, 0.15 wt.% of Co, 0.11 wt.% of Ni, and the balance being Zn.

6. A high-strength zinc base alloy consisting of 6.83 wt.% of Al, 5.52 wt.% of Cu, 0.047 wt.% of Mg, 0.03 wt.% of Ti, and the balance being Zn.

7. A high-strength zinc base alloy consisting of 6.73 wt.% of Al, 5.47 wt.% of Cu, 0.053 wt.% of Mg, 0.098 wt.% of Co, 0.106 wt.% of Ti, and the balance being Zn.

8. A high-strength zinc base alloy consisting of 6.90 wt.% of Al, 5.30 wt.% of Cu, 0.03 wt.% of Mg, 0.20 wt.% of Ni, 0.19 wt.% of Ti, and the balance being Zn.

9. A high-strength zinc base alloy consisting of 7.11 wt.% of Al, 5.30 wt.% of Cu, 0.018 wt.% of Mg, 0.15 wt.% of Co, 0.058 wt.% of Ni, 0.11 wt.% of Ti, and the balance being Zn.

* * * * *